US007141675B2

(12) United States Patent
Tappan et al.

(10) Patent No.: US 7,141,675 B2
(45) Date of Patent: Nov. 28, 2006

(54) PREPARATION OF NANOPOROUS METAL FOAM FROM HIGH NITROGEN TRANSITION METAL COMPLEXES

(75) Inventors: Bryce C. Tappan, Santa Fe, NM (US); My Hang V. Huynh, Los Alamos, NM (US); Michael A. Hiskey, Los Alamos, NM (US); Steven F. Son, Los Alamos, NM (US); David M. Oschwald, Santa Fe, NM (US); David E. Chavez, Rancho de Taos, NM (US); Darren L. Naud, Los Alamos, NM (US)

(73) Assignee: Los Alamos National Security, LLC, Los Alamos, NM (US)

( * ) Notice: Subject to any disclaimer, the term of this patent is extended or adjusted under 35 U.S.C. 154(b) by 105 days.

(21) Appl. No.: 10/964,218

(22) Filed: Oct. 12, 2004

(65) Prior Publication Data

US 2006/0078454 A1 Apr. 13, 2006

(51) Int. Cl.
*C07F 19/00* (2006.01)
*B22F 9/30* (2006.01)

(52) U.S. Cl. ..... 548/101; 977/773; 502/527.24; 419/1; 419/2; 419/13

(58) Field of Classification Search ..... 548/101; 502/527.24; 977/773; 419/1, 2, 13
See application file for complete search history.

(56) References Cited

U.S. PATENT DOCUMENTS 5,468,866 A 11/1995 Highsmith et al.
5,682,014 A 10/1997 Highsmith et al.
6,712,918 B1 * 3/2004 Mendenhall et al. ..... 149/36

OTHER PUBLICATIONS

Gibson, L., *Annu. Rev. Mater. Sci.* 2000, vol. 30, pp. 191-227.
Mukai, T.; Kanahashi, H.; Yamada, Y.; Shimojima, K.; Mabuchi, M.; Nieh, T.G.; Higashi, K. *Scripta Mater.* 1999, vol. 41, pp. 365-371.
Kanahashi, H.; Mukai, T.; Yamada, Y.; Shimojima, K.; Mabuchi, M.; Nieh, T.G.; Higashi, K. *Mater. Sci. Eng.* 2000, vol. A280, pp. 349-353.
Centi, G.; Arena, G. E.; Perathoner, S. *J. Catalysis* 2003, pp. 443-454.
Somorjai, G. A.; Yang, M. *Topics in Catalysis* 2003, vol. 24, pp. 61-72.
Erlebacher, J.; Aziz, M. J.; Karma, A.; Dimitrov, N.; Sieradzki, K. *Nature* 2001, vol. 410, pp. 450-453.
Hattori, Y.; Konishi, T.; Kanoh, H.; Kawasaki, S.; Kaneko, K. *Adv. Mater*, 2003, vol. 15, pp. 529-531.
Wakayama, H.; Fukushima, *Y. Chem. Comm.* 1999, pp. 391-392.
Nelson, P. A.; Elloit, J. M.; Attard, G. S.; Owen, J. R. *Chem. Mater.* 2002, 14, 524-529.
Liu, J.; Li, Y.; Wang, Y.; Wang, Z. L. *Chem. Mater.* 2001, 13, 1008-1014.
Suh, Dong Jin; Park, Tae-Jin *Chem. Mater.* 1996, 8, 509-513.

* cited by examiner

*Primary Examiner*—Porfirio Nazario-Gonzalez
(74) *Attorney, Agent, or Firm*—Samuel L. Borkowsky

(57) ABSTRACT

Nanoporous metal foams are prepared by ignition of high nitrogen transition metal complexes. The ammonium salts of iron(III) tris[bi(tetrazolato)-amine], cobalt(III) tris(bi(tetrazolato)amine), and high nitrogen compounds of copper and silver were prepared as loose powders, pressed into pellets and wafers, and ignited under an inert atmosphere to form nanoporous metal foam monoliths having very high surface area and very low density.

10 Claims, 8 Drawing Sheets

PREPARATION OF NANOPOROUS METAL FOAM FROM HIGH NITROGEN TRANSITION METAL COMPLEXES

STATEMENT REGARDING FEDERAL RIGHTS

This invention was made with government support under Contract No. W-7405-ENG-36 awarded by the U.S. Department of Energy. The government has certain rights in the invention.

FIELD OF THE INVENTION

The present invention relates generally to the preparation of high-nitrogen transition metal complexes and to transforming these complexes into high surface area, low-density nanoporous metal foam.

BACKGROUND OF THE INVENTION

Metal foams have been produced by melt processing, powder processing, deposition techniques, and other methods [1]. Melt processed foams are formed by using either a blowing agent such as a metal hydride, metal carbide, or metal oxide, or by using a lost-polymer investment casting. Metal foams produced using blowing agents often have an inhomogeneous cell structure and density that is due to the non-uniform distribution of blowing agent in the melt. These foams also tend to have a closed cell structure, which limits their uses to structural applications. Open celled foams are preferred for applications related to, for example, catalysis and heat transfer, because the open cell structure allows for the passage of fluid (gas, liquid) through the foam.

Nanostructured metals monoliths have been prepared using polymer or aerogel templates, electrodeposition, and etching of noble metal alloys [5,7]. Metal monoliths prepared by these methods are typically in the form of powders and thin films, and almost all of these methods require template removal to access the nanoporous metal.

The production of porous monolithic structures without using a template continues to be a challenge. Additional challenges are related to controlling the cell structure and shape of the porous monolith, which will likely have an impact on applications such as catalysis, electrode design, and sensor applications. Understanding the factors that control pore sizes in porous metal monoliths could be used in the rational design of nanoporous metals. Furthermore, the lack of generality and flexibility of the current methods in the preparation of nanoporous materials with a variety of different metals remains a problem. The ability to prepare a variety of different nanoporous metals would significantly expand the range and utility of porous metals.

Accordingly, an object of the present invention is a method for preparing porous metal.

Another object of the present invention is to provide materials that can be transformed into porous metal.

Yet another object of the present invention is to provide a general method for preparing nanoporous metal monoliths.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the purposes of the present invention, as embodied and broadly described herein, the present invention includes a method for preparing a nanoporous metal foam monolith. The method includes forming a pressed structure of a high nitrogen transition metal complex and igniting the pressed structure under an inert atmosphere to form the monolith.

The invention also includes a nanoporous metal foam monolith prepared by forming a pressed structure of a high nitrogen transition metal complex and igniting the pressed structure under an inert atmosphere.

The invention also includes a nanoporous metal foam monolith having a surface area of from about 17 $m^2/g$ (meters squared per gram) to about 260 $m^2/g$.

The invention also includes a chemical compound having the formula

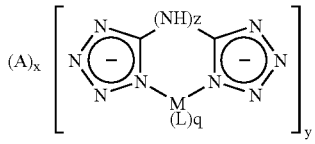

wherein A is selected from ammonium, hydrazinium, guanidinium, aminoguanidinium, diaminoguanidinium, and triaminoguanidinium; wherein x is zero or an integer from 1 to 3, wherein y is an integer from 1 to 3; wherein z is 0 or 1, wherein L is amine; wherein q is 0 or 2; and wherein M is a transition metal.

BRIEF DESCRIPTION OF THE DRAWINGS

The accompanying drawings, which are incorporated in and form a part of the specification, illustrate the embodiment(s) of the present invention and, together with the description, serve to explain the principles of the invention. In the drawings.

DETAILED DESCRIPTION

Figure 1:
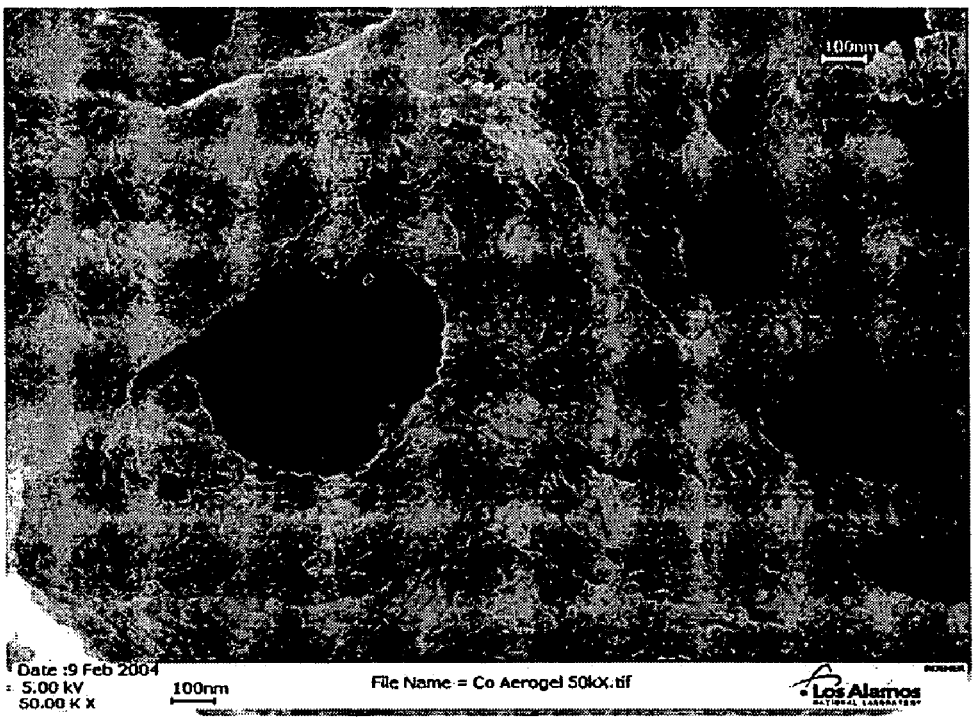
FIG. 1 shows an electron micrograph of cobalt nanoporous foam formed at nitrogen gas overpressure of about 980 psi according to the invention.

Briefly, the present invention relates to the preparation of high nitrogen complexes of transition metals and using them to prepare metal foam. Thermal decomposition of transition metal complexes (metal carbonyl complexes, for example)

typically does not lead to metal foam [8]. This invention, by contrast, uses transition metal complexes as precursors for preparing nanostructured metal foam monoliths.

One aspect of this invention relates to the high nitrogen transition metal complexes that are used for making nanostructured metal foam. These materials are chemical compounds having the formula

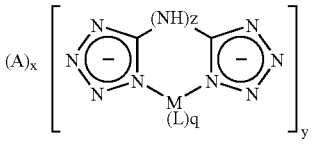

wherein A is selected from ammonium, hydrazinium, guanidinium, aminoguanidinium, diaminoguanidinium, and triaminoguanidinium; wherein x is zero or an integer from 1 to 3, wherein y is an integer from 1 to 3; wherein z is 0 or 1, wherein L is amine; wherein q is 0 or 2; and wherein M is a transition metal.

An embodiment complex was prepared by reacting hexaaquoiron(III) perchlorate with the ammonium salt of ligand bi(tetrazolato)amine according to the equation below. The product of the reaction is the corresponding ammonium salt of the octahedral iron complex iron(III) tris[bi(tetrazolato)amine] (1).

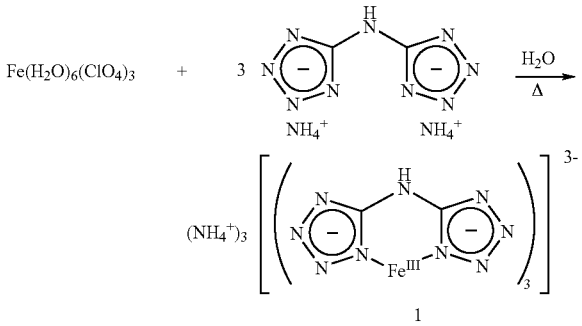

1

Compound 1 was isolated from aqueous solution as a loose powder. When ignited in air, compound 1 burned rapidly and produced orange sparks that suggested the presence of elemental iron.

Compound 1 was pressed into a pellet structure and ignited in a bomb apparatus. Under a pressure of about 300 psig of nitrogen, ignition of the pellet transformed compound 1 into a monolithic foam. Analysis by scanning electron microscopy (SEM) revealed that the monolith was a nanoporous foam with pore sizes on the order of from about 20 to about 50 nanometers.

Pellet ignition was accomplished using a resistively heated metal wire (a Constantine wire, a thin wire of nickel-chromium alloy, and the like). Thin wires were used to avoid cutting the foam as it forms. Prior to ignition, the pellet was slightly scored to secure the wire loop to the ignition area of the pellet.

A pellet having a size of 6.3 mm in diameter and 6.4 mm in length produced a nanoporous foam monolith that was about 6.1–6.5 mm in diameter and 21 mm in length. Based on the observation that foam monolith appears to form in the flame front of the ignited pellet, the shape of the pellet and the placement of the ignition wire have an effect on the shape of the corresponding foam monolith.

Foam monoliths were also produced from wafers. Typical dimensions for a wafer were on the order of about 12.6 mm in diameter by 3 mm in length. The shape of the resulting foam monoliths formed from wafers depended on whether the wafer was ignited at a central location, or at the edge, of the wafer.

While not intending to be bound by any particular explanation, it appears that the pores of the monolith as the high nitrogen ligand of compound 1, and the other high nitrogen compounds, liberate gases as they decompose.

After ignition, the resulting foam generally includes up to about 50 percent by weight metal. The remainder is mostly carbon and nitrogen. The carbon and nitrogen are removed when the foam is heated at an elevated temperature of about 800 degrees Celsius.

An important aspect of this invention relates to the low densities and high surface areas of the invention foams. Until now, the lowest achievable densities for metal foam have been in the range of from about 0.04 to about 0.08 g/cm$^3$ [1, 2, 3]. These are the densities observed for milliporous metal foams, where their low surface areas are due to the millimeter-scale cell size. By contrast, metal foams of this invention have even lower densities. In fact, metal foam with a density of 0.0111 g/cm$^3$ was prepared using this invention. With respect to the surface area, foams produced according to this invention are nanoporous and have much higher surface areas than those for known metal foams. A high surface area titania aerogel, for example, has a BET surface area calculated measuring $N_2$ adsorption isotherms was 100–200 m$^2$/g [9]. By contrast, the BET surface area of nanoporous foam of this invention produced by igniting a pressed pellet of an invention transition metal complex over a pressure of about 300 psi was 258 m$^2$/g, much higher than for the titania aerogel.

Foams of this invention that are produced at higher pressures (~1000 psi) tend to have BET surface areas in the range of from about 12 m$^2$/g to about 17 m$^2$/g.

The generality of the foam preparation was demonstrated by preparing transition metal complexes of the high nitrogen ligand with several different metals and by using the complexes to produce metal foam. Cobalt, silver, and copper complexes of the bi(tetrazolato)amine ligand used for preparing nanoporous iron were also prepared, pressed into pellets, and ignited; the result was nanostructured foam of cobalt, silver, and copper, respectively.

A Scanning Electron Microscopy (SEM) image of the cobalt foam is shown in FIG. 1. The image of the cobalt foam displays several morphologies. Two of the morphologies are pore morphologies, and a third is of small cobalt grains (~10 nm) that are aggregated to form the foam walls. This interesting grain size and morphology contributes to the high surface area of the cobalt foam.

Figure 2A:
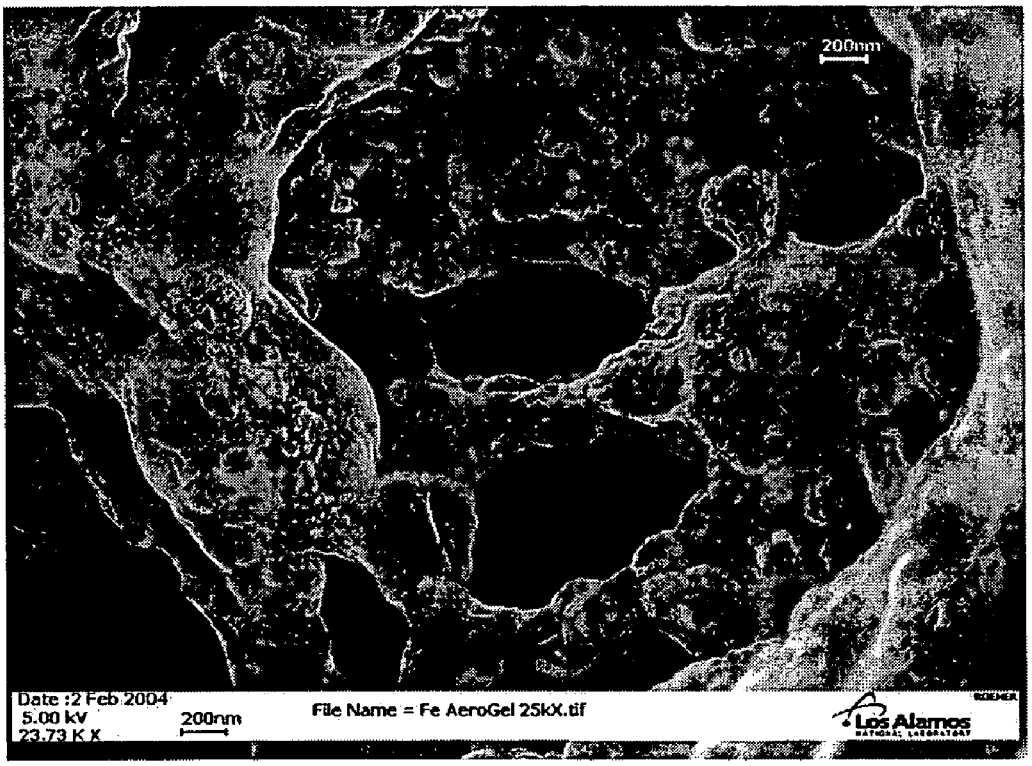
FIGS. 2*a* and 2*b* show electron micrographs of iron nanoporous foams of the invention prepared using nitrogen overpressures of 300 psi and 1064 psi, respectively.
Figure 2B:
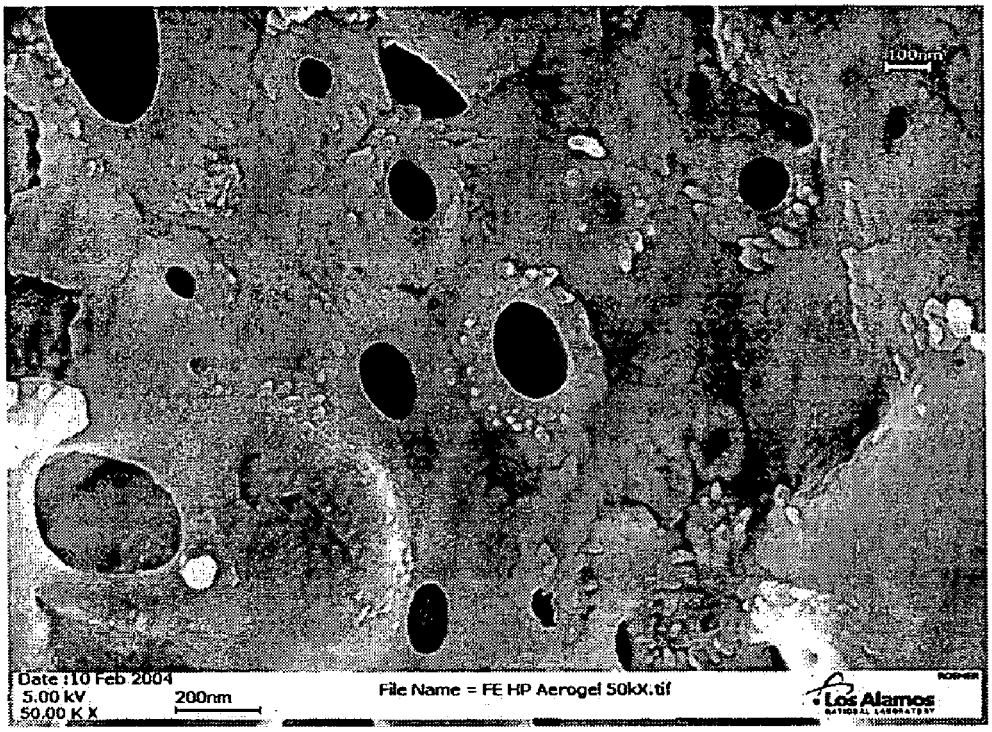

Variation of the combustion chamber pressure has an effect on the overall structure on the metallic foam, as illustrated in FIG. 2*a* and FIG. 2*b*. Two pellets of iron compound 1 were burned at under a nitrogen pressure of 300 psi (FIG. 2*a*) and 1064 psi (FIG. 2*b*), respectively. At 300 psi, two ranges of pore sizes were observed: micron sized pores and nanosized pores (20–200 nm). At 1064 psi, the foam appeared to include only the nanosized pores (20–200 nm).

The ignition is typically performed on the pellet under an inert atmosphere. Inert gases used included nitrogen and argon, and it is expected that helium and other inert gases and gas mixtures could also be used. Data collected using differential scanning calorimetry (DSC) and thermogravimetric analysis (TGA) indicate that metal nitrides are unlikely products when the ignition is performed under a nitrogen atmosphere. More likely products include carbon nitrides, but signals due to these products disappear at temperatures below about 800 degrees Celsius.

In addition to nanoporous metal foams, metallic nanopowders can also be obtained by applying a high-pressure flow to the burning surface of the pellet.

Optionally, energetic additives (5-amino-tetrazole, for example) can be included into the pellet in order to decrease the density of the resulting foam. Elements such as boron or sulfur might also be introduced into a sample of the transition metal complex before ignition, with the expectation of forming metal-borides and metal-sulfides as a part of the nanoporous foam that act as catalytically active sites.

Figure 3A:
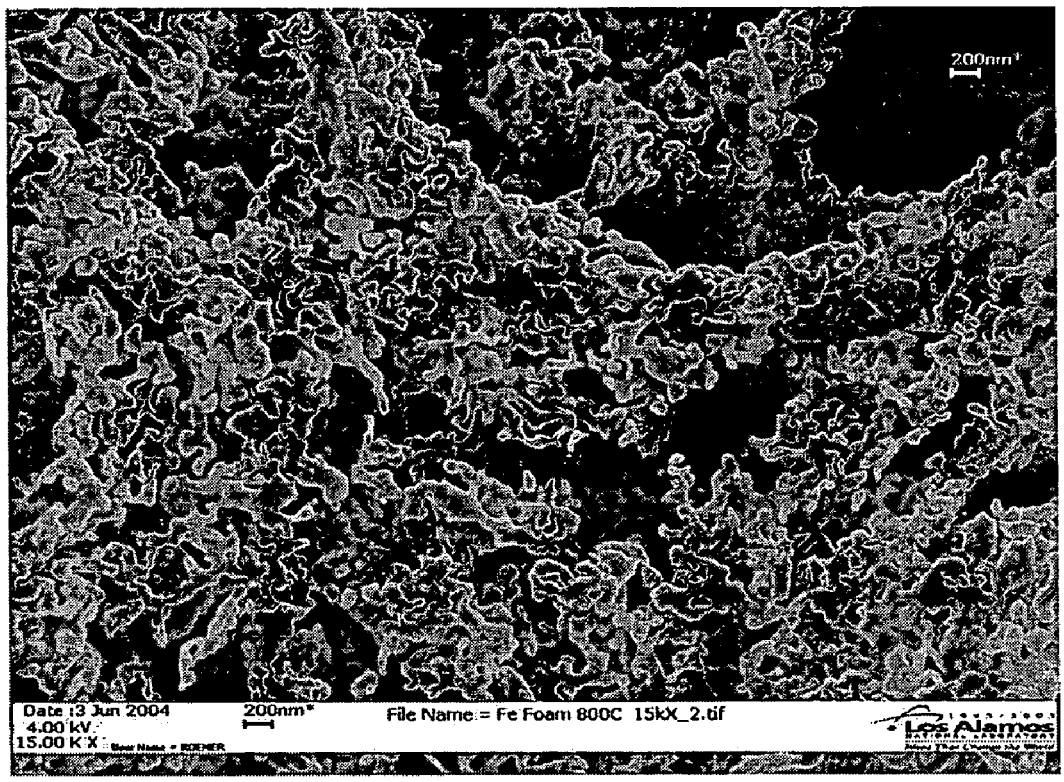
FIGS. 3*a* and 3*b* show scanning electron micrographs of an iron foam and a cobalt foam, respectively, after heating to a temperature of about 800 degrees Celsius.
Figure 3B:
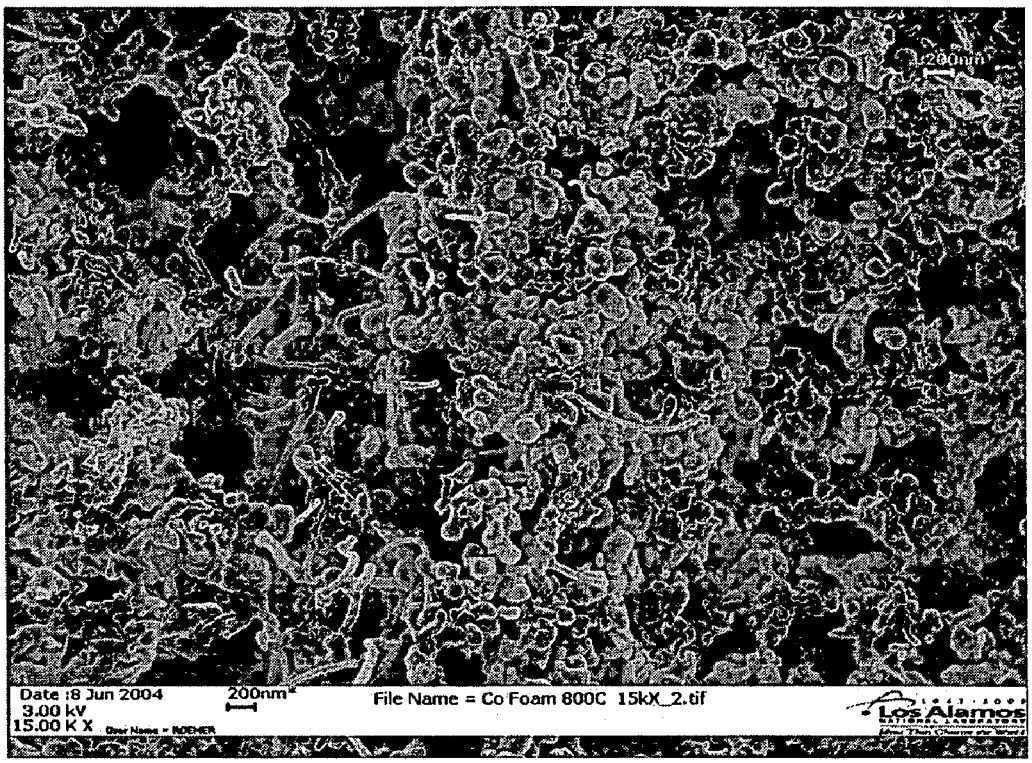
Figure 4A:
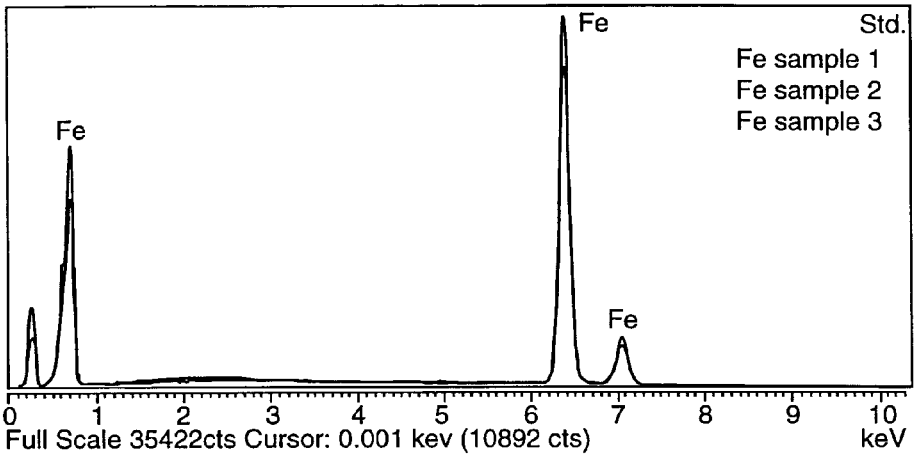
FIGS. 4*a* and 4*b* show energy dispersive spectra (EDS) of the metal foam shown in FIGS. 3*a* and 3*b* respectively, after heating. The spectra show that only metal, a small amount of carbon and trace oxygen in the cobalt (4*b*) spectrum.
Figure 4B:
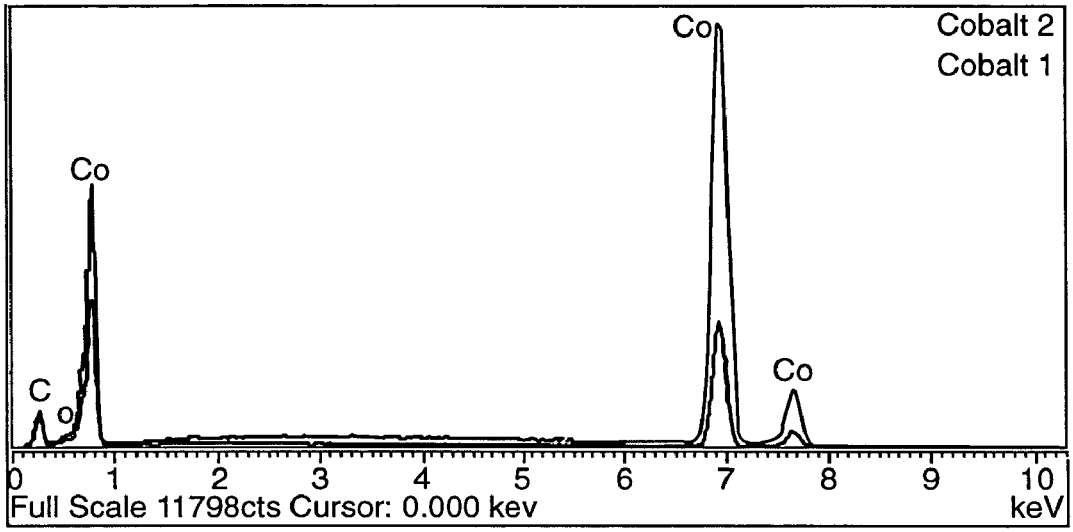

The foam produced after pellet ignition typically includes carbon and nitrogen impurities from the high nitrogen ligand portion of the transition metal complex. These impurities, which are observable and measurable elemental analysis, thermogravimetric analysis, and energy dispersive spectra (EDS), may be removed by heating the foam to a temperature of about 800 degrees Celsius under inert atmosphere (argon, for example). FIG. 3*a* and FIG. 3*b* show the SEM images for Fe and Co foams after being heated to about 800 degrees Celsius, and FIG. 4*a* and FIG. 4*b* show the corresponding EDS for the Fe and Co foam, respectively. The EDS spectra indicate that only a small amount of carbon is present in the foam after heat treatment. Thermogravimetric analysis (TGA) indicated that only about 9.7 percent residual carbon was present in the Fe foam shown in FIG. 3*a*; a trace amount of oxygen was also present, most likely resulting from oxidation after heating because no oxygen was observed before heating.

A copper foam was prepared from a copper complex including the bi(tetrazolato)amine ligand. After thermal treatment, analysis by EDS indicated that the copper foam included only a trace amount of carbon and oxygen.

An advantage of the invention is related to the ability to produce metal foam having with extremely fine structure and low density without the need for blowing apparatus and very high temperatures. The shape of the die used for pressing the transition metal complex determines the shape of the foam. Complex die shapes result in foams that have substantially the same complex shape as the die.

The following EXAMPLES provide detailed procedures for preparing embodiments of the high nitrogen transition metal complexes of the invention and procedures for transforming these embodiment complexes into foam.

EXAMPLE 1

Preparation of ammonium tris(bi(tetrazolato)amine)ferrate(III) (1). Iron (III) perchlorate hexahydrate $[Fe^{III}(H_2O)_6](ClO_4)_3$ (5.2 grams, 10.8 millimoles) and ammonium bi(tetrazolato)amine (6.07 g, 32.4 mmol) were added to about 50 ml of de-ionized water. The mixture was refluxed with stirring for about 5 hrs to yield a homogeneous blue solution. The volume of the solution was reduced to dryness. The solid product was extracted in a sohlet extractor using methanol as the solvent. A dark blue solid was recovered by filtration. The solid was washed with fresh methanol and dried in the air. Yield of ammonium tris(bi(tetrazolato)amine)ferrate(III) 1: 5.4 g (89%). An equation that summarizes the preparation is shown below.

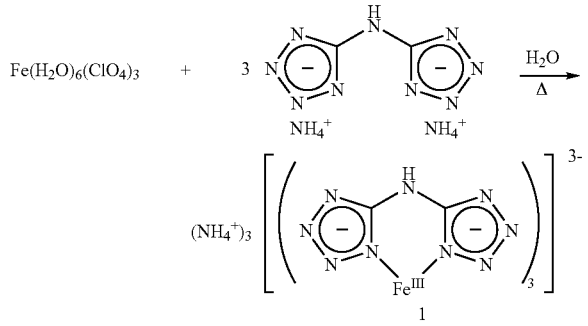

Compound 1 was subjected Differential Scanning Calorimetry (DSC); the observed decomposition temperature of compound 1 was 213 degrees Celsius. An infrared spectrum of a Nujol mull of compound 1 included the following peaks: 3557, 3239, 3139, 1610, 1541, 1319, 1253, 1158, 1123, 1073, 1048, 1011, 855, 802, 746, and 432 $cm^{-1}$. Compound 1 was also subjected to elemental analysis. Percentages of carbon, hydrogen, and nitrogen were calculated for $FeC_6H_{15}N_{30}$ as C, 12.79; H, 2.68; N, 74.61. The percentages found by elemental analysis were: C, 12.35; H, 3.05; N, 71.16.

EXAMPLE 2

Figure 5:
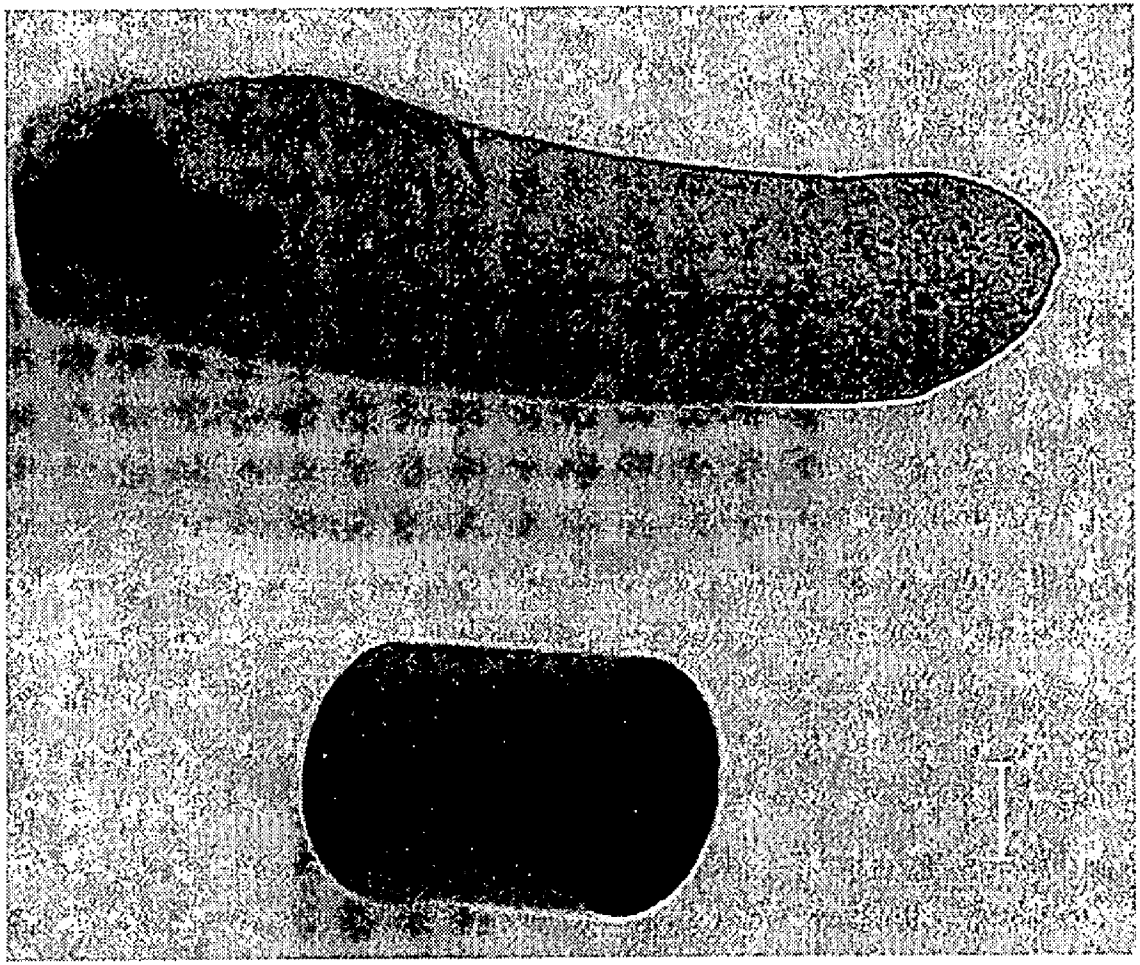
FIG. 5 shows an image of a pellet of ammonium tris(bi(tetrazolato)amine)ferrate(III) next to a column of foam monolith produced from a pellet of that size under an argon pressure of about 1005 psig argon. The scale above the pellet shows a distance of 4 mm.

Preparation of nanoporous iron foam from compound 1. A pellet (6.3 mm in diameter by 6.4 mm in length and 0.32 g) of compound 1 synthesized according to EXAMPLE 1 was pressed to maximum density in a hydraulic press and stainless steel die. The pellets were scored to secure a thin ignition wire to the ignition area. Ignition of the pellets under an inert atmosphere (argon or nitrogen) using the heated wire resulted in the production of a foam monolith (0.056 g, 6.1–6.5 mm in diameter by 21 mm in length). FIG. 5 shows an image of a pellet of ammonium tris(bi(tetrazolato)amine)ferrate(III) next to a column of foam monolith produced from a pellet of that size under an argon pressure of about 1005 psig argon. The scale above the pellet shows a distance of 4 mm.

A wafer (0.32 g, 12.6 mm in diameter by 3 mm in width) of compound 1 was also prepared and transformed using a resistively heated ignition wire to a monolith of irregular dimension weighing 0.052 g (16.2% of the weight of the wafer.

Carbon and nitrogen impurities were removed by heating the foam to a temperature of about 800 degrees Celsius (10% carbon residual in heated iron foam).

EXAMPLE 3

Synthesis of ammonium tris(bi(tetrazolato)amine)cobaltate(III) (2).

Cobalt (II) perchlorate hexahydrate $[Co^{II}(H_2O)_6](ClO_4)_3$ (5 grams, 17.2 mmol) and ammonium bi(tetrazolato)amine (9.65 g, 51.6 mmol) were added to about 70 mL of de-ionized water. The mixture was refluxed for 5 hours. About 10 ml of an aqueous 30 percent solution of hydrogen peroxide was added and the solution was stirred continuously for another 3 hours. The volume of the solution was reduced to dryness. The solid product was extracted in a sohlet extractor using methanol as the solvent. A solid was recovered by filtration, washed with fresh methanol, and dried in the air. Yield of 2: 8.1 g (84%). Fast decomposition from Differential Scanning Calorimetry (DSC) data: 251° C. IR (Nujol mull) 3517, 3230, 3157, 1611, 1553, 1491, 1322, 1261, 1165, 1135, 1113, 1097, 1018, 808, 742, and 471 $cm^{-1}$.

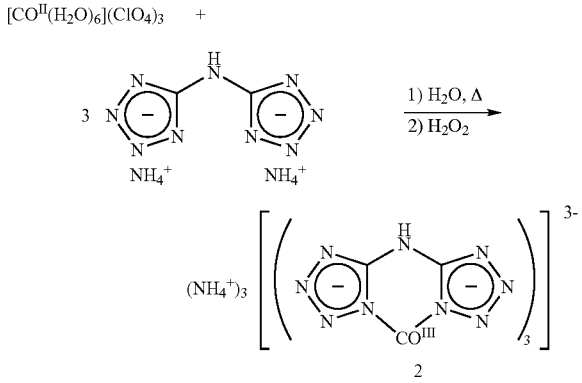

EXAMPLE 4

Synthesis of nanostructured cobalt foam. A pellet (0.165 g, 6.3 mm in diameter by 3.2 mm in length) of the cobalt (III) tris[bi(tetrazolato)-amine] complex synthesized according to the procedure of EXAMPLE 2 was pressed to maximum density in a hydraulic press and stainless steel die, scored, and ignited in the pressure apparatus under an inert atmosphere using a thin, resistively heated wire. Fractured pieces of foam weighing 0.011 g (6.7% of weight of the pellet) were collected. A portion of the collected foam was heated to a temperature over 800 degrees Celsius to remove impurities.

EXAMPLE 5

Synthesis of copper(II)diammine bis[bi(tetrazolato)-amine] complex (3). $Cu^{II}(H_2O)_5$ $SO_4$ (5 g, 20 mmol) and ammonium bi(tetrazolato)amine (3.39 g, 20 mmol) were added to about 50 ml of deionized water. The mixture was stirred and a bright green precipitate was formed of copper (II) bis[bi(tetrazolato)-amine dihydrate. The green solid was filtered and washed with deionized water. Excess ammonium hydroxide was added to an aqueous suspension of the green solid to form copper(II)diammine bis[bi(tetrazolato)-amine] complex (3). Yield: 4.3 g (86%). An equation for the synthesis of 3 is shown below.

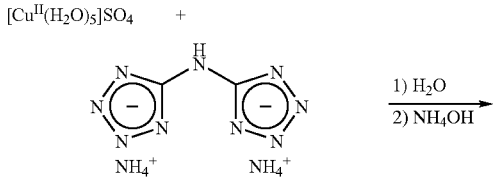

-continued

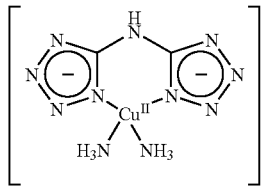

3

EXAMPLE 6

Preparation of nanostructured copper foam. A wafer (0.105 g) of the copper (II) bis[bi(tetrazolato)-amine] complex synthesized according to EXAMPLE 5 was pressed to maximum density in a hydraulic press and stainless steel die and ignited in the pressure apparatus under inert atmosphere using a thin resistively heated wire. The wafer was slightly scored to secure the loop of wire to the ignition area. 0.04 g (38% of original complex weight) of foam was collected. The copper foam was heated to a temperature over 800 degrees Celsius to remove impurities.

EXAMPLE 7

Synthesis of silver(I) tris[bi(tetrazolato)-amine] complex. Silver nitrate ($AgNO_3$, 5 g (29.4 mmol) and ammonium bi(tetrazolate) (5.5 g, 29.4 mmol) were added to about 50 ml of deionized water. The mixture was stirred and a white precipitate was formed. The white solid was filtered, washed with deionized water and methanol, and air-dried in a dark hood with an aluminum foil cover to shield the silver containing compound from light. Elemental Analysis: calculated for $Ag_2C_2H_5N_{10}$: C, 6.24; H, 1.30; N, 36.4. Found: C, 6.26; H, 0.725; N, 33.76.

EXAMPLE 8

Preparation of nanostructured silver foam. A pellet (0.165 g, 6.3 mm in diameter by 3.2 mm in length) of the silver complex prepared according to EXAMPLE 7 was prepared by pressing powder to maximum density in a hydraulic press and stainless steel die. The pellet was scored to secure a loop of thin wire to the ignition area, and then the wire was heated by resistance under an inert atmosphere in the pressure apparatus to ignite the pellet. Foam was collected as small shiny fractured pieces with bead-like morphologies.

Nanoporous metal foams, such as those prepared according to this invention, are useful for wide range of applications that include, but are not limited to, catalysis, magnetic applications, medicine, absorption, energetic compositions, and environmental remediation. The nanoporous metal foams of this invention most likely have an open cell structure, which makes them particularly useful in catalysis because they have very high surface areas and can store high volumes of fluid. These foams may be used as high surface area catalysts with fuel cells, catalysts for $NO_x$ removal [4,5], in biomedical sensors [6], and for improving biocompatibility of bone replacement implants, among other things.

In summary, this invention provides a general and flexible method for preparing nanoporous metal foams from high nitrogen transition metal complexes. It is expected that the foams of this invention will be used for catalysis and other important applications.

The foregoing description of the invention has been presented for purposes of illustration and description and is not intended to be exhaustive or to limit the invention to the precise form disclosed, and obviously many modifications and variations are possible in light of the above teaching.

The embodiment(s) were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

The following references are incorporated by reference herein.

REFERENCES

1. Gibson, L., *Annu. Rev. Mater. Sci.* 2000, vol. 30, pp. 191–227
2. Mukai, T.; Kanahashi, H.; Yamada, Y.; Shimojima, K.; Mabuchi, M.; Nieh, T. G.; Higashi, K. *Scripta Mater.* 1999, vol. 41, pp. 365–371.
3. Kanahashi, H.; Mukai, T.; Yamada, Y.; Shimojima, K.; Mabuchi, M.; Nieh, T. G.; Higashi, K. *Mater. Sci. Eng.* 2000, vol. A280, pp. 349–353.
4. Centi, G.; Arena, G. E.; Perathoner, S. *J. Catalysis* 2003, pp. 443–454.
5. Somorjai, G. A.; Yang, M. *Topics in Catalysis* 2003, vol. 24, pp. 61–72.
6. Erlebacher, J.; Aziz, M. J.; Karma, A.; Dimitrov, N.; Sieradzki, K. Nature 2001, vol. 410, pp. 450–453.
7. (a) Hattori, Y.; Konishi, T.; Kanoh, H.; Kawasaki, S.; Kaneko, K. *Adv. Mater.* 2003, vol. 15, pp. 529–531. (b) Wakayama, H.; Fukushima, Y. *Chem. Comm.* 1999, pp. 391–392. (c) Nelson, P. A.; Elloit, J. M.; Attard, G. S.; Owen, J. R. *Chem. Mater.* 2002, 14, 524–529.
8. Liu, J.; Li, Y.; Wang, Y.; Wang, Z. L. *Chem. Mater.* 2001, 13 1008–1014. Suh, Dong Jin; Park, Tae-Jin *Chem. Mater.* 1996, 8, 509–513.

What is claimed is:

1. A method for preparing a nanoporous metal foam monolith comprising:

forming a pressed structure of a high nitrogen transition metal complex of the formula

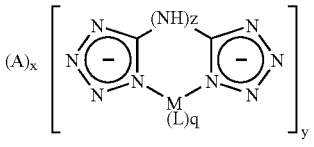

wherein A is selected from ammonium, hydrazinium, guanidinium, aminoguanidinium, diaminoguanidinium, and triaminoguanidinium; wherein x is zero or an integer from 1 to 3, wherein y is an integer from 1 to 3; wherein z is 0 or 1, wherein L is amine; wherein q is 0 or 2; and wherein M is a transition metal; and igniting the pressed structure under an inert atmosphere.

2. The method of claim 1, wherein the transition metal complex comprises metal selected from the group consisting of titanium, vanadium, chromium, iron, cobalt, nickel, and copper.

3. Monolithic nanoporous metal foam prepared by forming a pressed structure of a high nitrogen transition metal complex of the formula

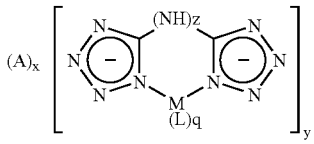

wherein A is selected from ammonium, hydrazinium, guanidinium, aminoguanidinium, diaminoguanidinium, and triaminoguanidinium; wherein x is zero or an integer from 1 to 3, wherein y is an integer from 1 to 3; wherein z is 0 or 1, wherein L is amine; wherein q is 0 or 2; and wherein M is a transition metal; and igniting the pressed structure under an inert atmosphere.

4. The metal foam of claim 3, wherein said foam comprises metal selected from the group consisting of titanium, vanadium, chromium, iron, cobalt, nickel, and copper.

5. Monolithic nanoporous metal foam comprising a surface area of from about 17 $m^2/g$ to about 260 $m^2/g$.

6. The foam of claim 5, wherein said foam comprises at least one transition metal.

7. The foam of claim 5, wherein said foam comprises a metal selected from the group consisting of titanium, vanadium, chromium, iron, cobalt, nickel, capper, and mixtures thereof.

8. The foam of claim 7, wherein said foam further comprises carbon, nitrogen, hydrogen, oxygen, or mixtures thereof.

9. A chemical compound having the formula

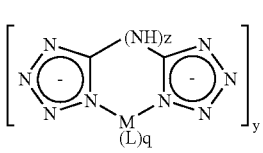

wherein A is selected from ammonium, hydrazinium, guanidinium, aminoguanidinium, diaminoguanidinium, arid triaminoguanidinium: wherein x is zero or an integer from 1 to 3, wherein y is an integer from 1 to 3; wherein z is 0 or 1, wherein L is amine; wherein q is 0 or 2; wherein M is a transition metal, with the caveat that when z is 0, the transition metal is not copper.

10. The compound of claim 9 wherein the transition metal is selected from the group consisting of titanium, vanadium, chromium, iron, cobalt, nickel, and copper, with the caveat that when z is 0, the transition metal is not copper.

* * * * *